United States Patent [19]

Ou-Yang

[11] Patent Number: 4,666,052

[45] Date of Patent: May 19, 1987

[54] TAMPER INDICATING CAP ASSEMBLY

[75] Inventor: David T. Ou-Yang, Cottage Grove, Minn.

[73] Assignee: Minnesota Mining and Manufacturing Company, St. Paul, Minn.

[21] Appl. No.: 737,819

[22] Filed: May 23, 1985

[51] Int. Cl.[4] ..... B65D 53/04

[52] U.S. Cl. ..... 215/230; 215/347; 428/467

[58] Field of Search ..... 215/230, 232, 347; 428/467

[56] References Cited

U.S. PATENT DOCUMENTS

| | | | |
|---|---|---|---|
| 2,044,922 | 6/1936 | Swift et al. | 428/467 |
| 2,077,992 | 4/1937 | Eisen | 215/347 |
| 2,099,641 | 11/1937 | Bach et al. | 428/467 |
| 2,131,774 | 10/1938 | Waring | 215/7 |
| 2,964,867 | 12/1960 | Kingsley | 428/467 |
| 4,418,834 | 12/1983 | Helms | 215/232 X |
| 4,502,605 | 3/1985 | Wloszczyna | 215/230 |
| 4,505,399 | 3/1985 | Weiner | 215/230 |

*Primary Examiner*—Donald F. Norton

*Attorney, Agent, or Firm*—Donald M. Sell; James A. Smith; David L. Weinstein

[57] ABSTRACT

An inner seal for containers that is capable of providing a visual indication of tampering. The innerseal comprises a membrane that it at least partially translucent, a layer of heat flowable material coated on one major surface of the translucent membrane, a rupturable, non-translucent membrane overlying the layer of heat flowable material, and an adhesive or heat-sealable composition overlying the surface of the rupturable membrane that is not in contact with the heat flowable material.

10 Claims, 5 Drawing Figures

TAMPER INDICATING CAP ASSEMBLY

BACKGROUND OF THE INVENTION

Field of the Invention

This invention relates to an improvement in inner seals for caps for bottle or other containers. The caps are capable of providing a visual indication, at the point of purchase, or at least before use, as to whether the bottle or container has been previously opened.

Description of the Prior Art

Removal of a container seal and replacement of the seal by one other than the purchaser of the container is a problem that has existed for some time. Adulteration of the contents of a container can cause extreme physical harm to the consumer and extreme harm to the goodwill of the seller. Accordingly, there is a great need to afford the consumer an opportunity to readily determine whether or not the seal of a container has been previously opened or tampered with since the container left the manufacturer or packaging company. Barriers within a container cap to seal the container have become required by law, but conventional caps must typically be removed at the point of purchase to determine in fact whether or not any tampering was undertaken relative to the inner seal.

U.S. Pat. No. 2,131,774 discloses a cap which is used to force a plate against a liner or gasket to seal the top of a bottle. Between the plate and the cap is a rupturable disk of fibrous or other suitable rupturable material having impressed thereon a safety design of a type intended to make the duplication or counterfeit of the disk as difficult as possible. It is desirable to bond the disk to the plate by use of a suitable adhesive or cement. The cap, however, is provided with prongs, which, after the cap is in place, are forced downward to penetrate the rupturable disk in areas above a groove formed in the metal plate. When opening the container, it is necessary for the consumer to impart a reverse turning movement to the closure. During the first portion of this movement, the metal shell will turn independently of the packing liner or gasket, the plate and the rupturable disk, and the prongs will move along the groove and tear the material of the disk, thereby forming jagged and irregular tears therein. After the prongs have once been placed through the disk, it is difficult to remove the cap in a manner which could avoid detection.

SUMMARY OF THE INVENTION

The present invention provides a tamper indicating cover member suitable for use on a wide variety of containers comprising a cap having at least a portion of the top thereof being translucent, i.e., translucent or transparent, and an inner seal for sealing to the container after same has been filled.

The inner seal comprises a transparent or translucent membrane, e.g. paper or film, adhered to a membrane of rupturable material, e.g. metal foil, that is at least partially non-translucent, i.e. non-translucent or non-transparent by means of a layer of heat flowable material selected from wax, a derivative thereof, low molecular weight, low tack adhesive, or mixtures thereof interposed between the translucent membrane and non-translucent membrane. The inner seal further comprises an adhesive or heat-sealable film coated over the rupturable membrane on the surface opposite the surface bearing the layer of heat flowable material to bond the inner seal to the lip of the container. Optionally, a transparent or translucent adhesive or heat-sealable film can be coated over the translucent membrane on the surface opposite that bearing the layer of heat flowable material.

The inner seal assembly can be formed into a disk shaped to be placed in a container cap. The translucent membrane will be in face-to-face contact with the cap. After the container is filled, the cap inner seal is placed on the container. Suitable means, e.g. induction heating, is utilized to seal the rupturable membrane of the inner seal to the lip of the container.

The relative rotation between the cap and the container ruptures the non-translucent membrane, the break in which ruptured membrane can be seen through the translucent cap and translucent membrane, thus providing an indication of closure tampering.

The present invention has the advantage of being suitable for use with cap lining equipment and induction sealing equipment conventionally used to seal cap lining materials to containers at the time they are filled.

DETAILED DESCRIPTION

Figure 1:
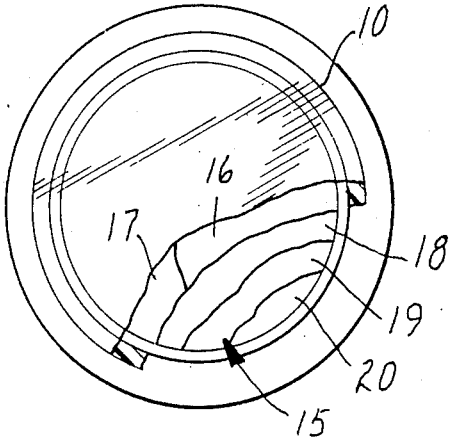
FIG. 1 is a top view of a cap and liner with portions thereof broken away to illustrate interior layers.

As used herein, the term "translucent" shall include translucent and transparent, and the term "non-translucent" shall include non-translucent and non-transparent.

The present invention provides an improved cap and liner which when sealed to a container with the cap attached will provide a tamper-indicating closure for the container by means of which tampering can be readily detected at the point of purchase. As illustrated in the attached drawings, where like numerals on the various figures illustrate identical parts, a cap 10 is formed from a translucent or transparent polymer, having a top and connecting side walls with internal threads 11 to mate with threads 12 provided on the outer surface about the neck and opening of container 13. Cap 10 can also be a snap fitted cap to mate with a rib formed about the opening of the container, such as conventional child-proof caps having an arrow thereon which is rotated to match an arrow or location on the container, at which location the cap may be readily snapped off. The threaded cap is chosen for purposes of illustration. Cap 10 is preferably formed of a polyolefin or other suitable polymeric material. Furthermore, at least a portion of the cap surface should be translucent or transparent for reasons hereafter described.

A cap inner seal generally designated by the reference numeral 15 is typically placed inside the cap by the cap manufacturer. The packager will use the cap with the inner seal already placed in the cap. Cap inner seal 15 comprises a membrane or disk 16 of transparent or translucent material, preferably paper or film, preferably coated with an adhesive or a heat sealable material, or both, designated as 17. Membrane 16 preferably has a thickness of less than about 10 mils. Examples of materials suitable for membrane 16 include 35 lb. bleached vellum or pouch paper, commercially available from Rhinelander Paper Company, and polymeric films such as polypropylene and polyester. In addition, printed messages may also be applied to membrane 16.

On the opposite surface of membrane 16 from the surface that may bear optional adhesive or heat sealable layer 17 is a layer 18 of heat flowable material selected from wax, a derivative thereof, a low molecular weight, low tack adhesive, or mixtures thereof. Commercially available waxes for use herein should typically have a melting point of less than about 200° F., and preferably have a penetration, as determined pursuant ASTM D1321, of between about 15 and about 45. Microcrystalline waxes are preferred. Examples of waxes suitable for this purpose include $B^2$-175 (Bareco), Multiwax W-835 (Witco Chemical).

Laminated to layer 18 is a rupturable membrane 19 that is at least partially non-transparent or non-translucent. The rupturable membrane 19 is preferably capable of being heated by means of induction heating. Materials preferable for rupturable membrane 19 are metal foils, preferably having a thickness of less than about 2.0 mils, and more preferably less than about 1.0 mil. Examples of metal foils that are suitable for membrane 19 include aluminum and stainless steel. Membrane 19 can also contain printing or a color other than that of the finish of the foil thereon. The material of layer 18 is coextensive with membrane 16 and membrane 19.

Coated onto foil 19 on the surface opposite that bearing the wax layer 18 is film 20 of adhesive or heat sealable composition or a combination of both. Representative examples of heat sealable materials include ethylene vinyl acetate, polyethylene, polyvinyl chloride, polyethylene terephthalate, polystyrene, and polypropylene. The specific choice depends upon the type of containers to be sealed. A preferred adhesive for film 20 is that disclosed in U.S. application Ser. No. 578,652, incorporated herein by reference. The material of layer 20 can be the same or different from that of optional layer 17.

The inner seal assembly can be punched from a web to form a disk shaped to be placed in a cap by means of conventional machinery for inserting cap inner seals into caps.

As the inner seal is passed through conventional induction heating fields, membrane 19 heats up instantaneously, causing a melting of wax or adhesive layer 18, further causing either partial detackification or absorption thereof by or mixing with membrane 16. The adhesion between membrane 19 and membrane 16 is thus sharply decreased around the highly pressurized edge area of the inner seal. The adhesion is substantially maintained at the central portions of membrane 19 and membrane 16.

At the same time, optional adhesive or heat sealable layer 17 and adhesive or heat sealable layer 20 are melted and thus become bonded to the inside of the cap and to the lip of the container, respectively.

When cap 10 is opened, membrane 19 will be torn by unscrewing cap 10, or by removal of the cap if a snap cap construction is utilized.

Figure 4:
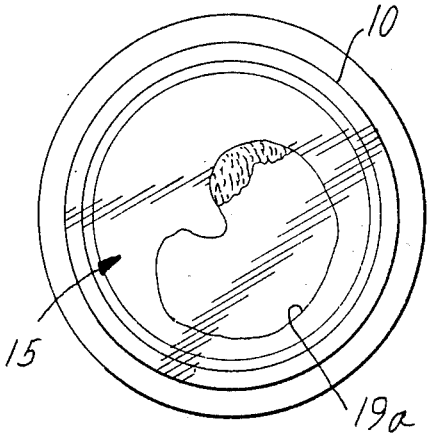
FIG. 4 is a diagramatic top view of the cap after it has been opened.
Figure 3:
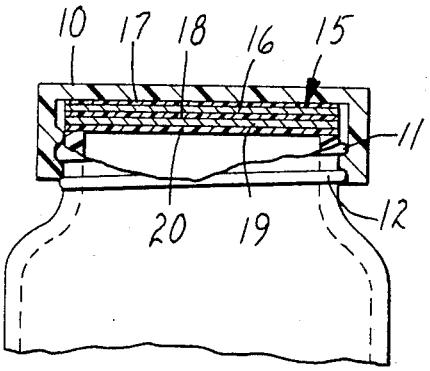
FIG. 3 is a vertical sectional view of a cap and liner constructed in accordance with the present invention sealed to a container.
Figure 5:
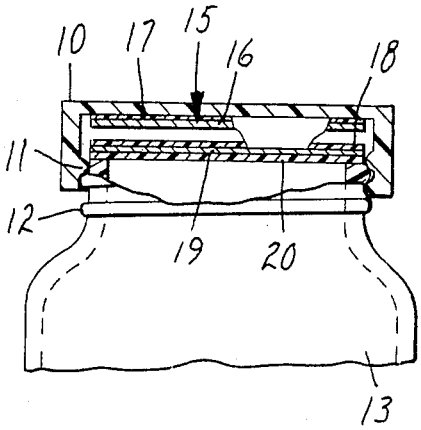
FIG. 5 is a vertical sectional view of the cap as it is opened.
Figure 2:
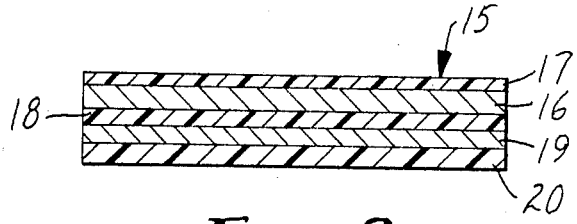
FIG. 2 is a cross-sectional view illustrating the construction of the web of liner material from which the cap liners are die cut.

As illustrated in FIGS. 4 and 5, rotation of cap 10 in an unwinding direction, with membrane 16 in place causes membrane 19 to rupture or tear an opening as illustrated at 19*a*. Continued relative rotation of the cap about the container will result in membrane 19 being torn and separated from membrane 16 as illustrated in FIG. 5, thereby providing through the transparent or translucent cap 10 a clear visual indication that the cap has been previously opened or tampered with.

Having disclosed the invention with reference to the preferred embodiment, it is understood that modifications that can be made without departing from the spirit or scope of the invention as defined in the appended claims.

What is claimed is:

1. Sheet material for providing a tamper-indicating inner seal for a translucent or transparent cover member attachable to a container comprising (a) a rupturable membrane that is at least partially non-translucent;

(b) overlying and coextensive with one major surface of said rupturable membrane a layer of heat flowable material selected from the group consisting of wax, wax derivative, low tack adhesive, and mixtures thereof;

(c) overlying and coextensive with said layer of heat flowable material a translucent or transparent membrane; and (d) overlying the other major surface of said rupturable membrane a first adhesive or heat-sealable composition, the surface of said translucent or transparent membrane opposite the surface in contact with said layer of heat flowable material bearing a second adhesive or heat sealable composition.

2. Sheet material for providing a tamper-indicating inner seal for a translucent or transparent cover member attachable to a container comprising (a) a rupturable membrane that is at least partially non-translucent and comprising aluminum foil;

(b) overlying and coextensive with one major surface of said rupturable membrane a layer of heat flowable material selected from the group consisting of wax, wax derivative, low tack adhesive, and mixtures thereof;

(c) overlying and coextensive with said layer of heat flowable material a translucent or transparent membrane; and (d) overlying the other major surface of said rupturable membrane an adhesive or heat-sealable composition.

3. A tamper-indicating cap for use in sealing an opening in a container, comprising:

(a) a transparent or translucent cap having a top and connecting side walls;

(b) a translucent or transparent membrane placed in said top;

(c) a rupturable membrane that is at least partially non-translucent;

(d) a layer of heat flowable material selected from the group consisting of wax, wax derivative, low tack adhesive, and mixtures thereof interposed between and coextensive with said rupturable membrane and said translucent or transparent membrane; and (e) an adhesive or a heat sealable composition on said rupturable membrane for attachment of said rupturable membrane to a container about its opening, whereby after said cap is affixed to a container, relative movement between said cap and said container will rupture said rupturable membrane.

4. The tamper-indicating cap of claim 3 wherein said translucent or transparent membrane further contains a second adhesive or heat sealable composition on the surface of said translucent or transparent membrane opposite from the surface of said translucent or transparent membrane bearing said layer of heat flowable material.

5. The tamper-indicating cap of claim 3 wherein said rupturable membrane comprises a metallic foil.

6. The tamper-indicating cap of claim 3 wherein said translucent or transparent membrane comprises paper or a polymeric film.

7. A container having a tamper-indicating translucent or transparent cap removably mounted over an opening in said container, said cap having a top and connecting side walls, said cap further having an inner seal comprising a translucent or transparent membrane, a rupturable membrane that is at least partially non-translucent, a layer of heat flowable material selected from the group consisting of wax, wax derivative, low tack adhesive, and mixtures thereof interposed between and coextensive with said rupturable membrane and said translucent or transparent membrane, said rupturable membrane being fixedly attached by means of an adhesive or heat sealed composition to said container such that relative movement between said container and cap causes the rupturing of said rupturable membrane.

8. The container of claim 7 wherein said rupturable membrane contains printing or a color other than that of the finish of said rupturable membrane.

9. The container of claim 8 wherein a printed message appears on said rupturable membrane which is impaired upon relative movement of said cap and said container.

10. Sheet material for providing a tamper-indicating inner seal for a translucent or transparent cover member attachable to a container comprising (a) a rupturable membrane that is at least partially non-translucent and comprising stainless steel;

(b) overlying and coextensive with one major surface of said rupturable membrane a layer of heat flowable material selected from the group consisting of wax, wax derivative, low tack adhesive, and mixtures thereof;

(c) overlying and coextensive with said layer of heat flowable material a translucent or transparent membrane; and (d) overlying the other major surface of said rupturable membrane an adhesive or heat-sealable composition.

* * * * *